US010477984B2

(12) United States Patent
Arnold

(10) Patent No.: US 10,477,984 B2
(45) Date of Patent: Nov. 19, 2019

(54) UNIVERSAL ACCESSIBLE HOLDER AND DISPENSING UNITS

(71) Applicant: Aaron Arnold, Sammamish, WA (US)

(72) Inventor: Aaron Arnold, Sammamish, WA (US)

( * ) Notice: Subject to any disclaimer, the term of this patent is extended or adjusted under 35 U.S.C. 154(b) by 0 days.

(21) Appl. No.: 16/009,674

(22) Filed: Jun. 15, 2018

(65) Prior Publication Data

US 2018/0360232 A1 Dec. 20, 2018

Related U.S. Application Data

(60) Provisional application No. 62/520,824, filed on Jun. 16, 2017.

(51) Int. Cl.

| | |
|---|---|
| ***A47F 1/00*** | (2006.01) |
| ***A47F 10/02*** | (2006.01) |
| ***A47B 96/04*** | (2006.01) |
| ***A47B 81/04*** | (2006.01) |
| ***A47F 7/14*** | (2006.01) |

(Continued)

(52) U.S. Cl.

CPC ..... *A47F 1/00* (2013.01); *A47B 81/04* (2013.01); *A47B 96/04* (2013.01); *A47F 5/0062* (2013.01); *A47F 7/146* (2013.01); *A47F 10/02* (2013.01); *A47F 10/06* (2013.01); *A47G 2200/042* (2013.01)

(58) Field of Classification Search

CPC .... A47F 1/00; A47F 10/02; A47F 1/04; A47F 1/08; A47F 3/14; A47F 5/0025; A47F 5/0018; A47F 5/0043; A47F 5/005; A47F 5/0062; A47F 7/0007; A47F 7/0028; A47F 7/0042; A47F 7/0071; A47F 7/03; A47F 7/14; A47F 7/146; A47F 10/06; A47B 81/04; A47B 96/04; A47G 19/30; A47G 23/06; A47G 2200/04; A47G 2200/042; A47G 2400/06; A47G 2400/062

USPC ..... 211/85.26, 59.2, 126.1, 10, 85.4, 55, 211/128.1; 312/117, 118, 128; 206/557, 206/558, 561; 220/500, 556; D19/90; D7/590, 600.1, 600.4, 550.1, 553.1, 555, D7/401.1

See application file for complete search history.

(56) References Cited

U.S. PATENT DOCUMENTS 263,591 A * 8/1882 Roeder, Sr. ..... A47F 7/145 211/55
557,095 A * 3/1896 Tate ..... B65F 1/06 312/211

(Continued)

*Primary Examiner* — Jennifer E. Novosad
(74) *Attorney, Agent, or Firm* — Dean A. Craine

(57) ABSTRACT

A universal accessible kitchenette holder and dispensing unit configured to be setup in a horizontal serving surface to provide easy access by disabled and non-disabled to various items commonly used in a lunch room or kitchenette, such as plates, cups, napkins, utensils, small food items and packaged condiments, and etc. Each unit includes two L-shaped outer side walls, a lower tier front wall, a bottom panel, a rear wall, and an upper tier front wall. An intermediate floor panel may be disposed between the two side walls dividing the unit into a lower tier and an upper tier. Each tier is divided into one or more bins by dividing walls. Extending forward from each front wall are optional extensions. Also formed on the front wall of the lower and upper tiers are optional tactile indicators used by visually handicapped individuals to identify the contents in the bins directly behind the front wall.

7 Claims, 8 Drawing Sheets

(51) Int. Cl.
*A47F 5/00* (2006.01)
*A47F 10/06* (2006.01)

(56) References Cited

U.S. PATENT DOCUMENTS 570,972 A * 11/1896 Wallis ..... A47F 3/00 312/117
726,380 A * 4/1903 Ullathorne ..... B65D 1/34 206/45.28
740,927 A * 10/1903 Roberts ..... A47F 5/112 211/73
1,266,708 A * 5/1918 Ozanne ..... A47F 7/145 206/561
1,303,185 A * 5/1919 Eichling, Jr. ..... A47F 5/10 211/128.1
1,361,451 A * 12/1920 Flannery, Jr. ..... A47F 3/00 126/200
1,473,868 A * 11/1923 Pinten ..... A47F 3/005 211/55
1,565,889 A * 12/1925 Baker ..... A47F 3/00 312/118
1,578,819 A * 3/1926 Freeland ..... A47F 5/0025 206/561
1,595,437 A * 8/1926 Webster ..... A47F 7/145 206/741
1,609,945 A * 12/1926 Hermani ..... A47F 3/14 211/135
1,662,637 A * 3/1928 Chase ..... A47F 5/0018 211/128.1
1,739,730 A * 12/1929 Orthwine ..... A47F 5/0062 206/459.5
1,815,651 A * 7/1931 Fieldstein ..... A47F 3/14 211/128.1
1,823,396 A * 9/1931 Goulet ..... A47F 5/0025 211/126.15
1,824,683 A * 9/1931 Peterson ..... A47F 3/14 206/557
1,873,557 A * 8/1932 Davis ..... A47F 3/14 206/561
1,903,936 A * 4/1933 Nunnery ..... A47F 7/146 211/128.1
1,928,594 A * 9/1933 Kearney ..... F25C 5/18 211/128.1
1,955,370 A * 4/1934 Snook ..... A47F 5/0018 211/128.1
1,958,520 A * 5/1934 Morton ..... A47F 5/005 211/128.1
D93,082 S * 8/1934 Wright ..... 211/128.1
D95,328 S * 4/1935 Ginsburg ..... 211/10
1,998,481 A * 4/1935 Yoder ..... B65D 5/528 206/561
2,109,255 A * 2/1938 Mapson ..... A47F 5/0062 211/128.1
2,252,306 A * 8/1941 Raucci ..... A47F 7/146 206/424
2,283,301 A * 5/1942 Waddell ..... A47F 5/0018 211/128.1
2,304,756 A * 12/1942 Ames ..... A47F 7/146 211/128.1
2,492,912 A * 12/1949 Womack ..... A47F 1/12 211/59.2
2,503,419 A * 4/1950 Secunde ..... A47F 3/0408 211/128.1
2,518,779 A * 8/1950 Hennessey ..... B65D 5/5266 206/45.3
2,914,184 A * 11/1959 Dgetluck ..... A47F 5/112 211/128.1
2,934,214 A * 4/1960 Mogulescu ..... A47F 5/10 211/126.12
3,210,865 A * 10/1965 Muntz ..... G09B 1/06 211/55
3,224,822 A * 12/1965 Kirby ..... A47F 1/126 206/503
3,236,371 A * 2/1966 Regis, Jr. ..... B42F 17/08 206/555
3,874,758 A * 4/1975 Isaacs ..... A47F 1/04 312/126
3,990,752 A * 11/1976 Hoffman ..... B65D 5/542 312/118
3,999,662 A * 12/1976 Barnhardt ..... A47F 5/112 211/126.16
D262,928 S * 2/1982 Medders ..... D3/310
4,369,887 A * 1/1983 Emery ..... A47F 1/12 211/126.3
4,384,647 A * 5/1983 Schweizer ..... A45C 11/00 206/371
4,753,341 A * 6/1988 McIntyre ..... B65D 5/48018 211/130.1
4,775,057 A * 10/1988 Zingeser ..... A47F 7/28 206/366
4,811,872 A * 3/1989 Boyd ..... B67D 1/06 141/86
4,955,677 A * 9/1990 Song ..... A47F 7/146 211/128.1
D333,219 S * 2/1993 Farber ..... D6/661.3
5,228,590 A * 7/1993 Blasko ..... B65D 83/02 206/504
5,284,257 A * 2/1994 Schum ..... A47F 5/0846 211/128.1
5,485,928 A * 1/1996 Felton ..... A47F 7/145 211/128.1
5,496,103 A * 3/1996 Kozak ..... A47F 3/005 312/116
5,505,315 A * 4/1996 Carroll ..... A47F 1/125 211/51
D394,565 S * 5/1998 Wang ..... D6/675.4
D395,574 S * 6/1998 Pope ..... D6/683.1
D395,577 S * 6/1998 Miller ..... D19/77
5,803,275 A * 9/1998 Schweitzer ..... B43M 99/008 211/10
6,105,796 A * 8/2000 Buchanan ..... A47F 9/04 186/59
6,789,684 B1 * 9/2004 Drower ..... B42F 17/02 211/11
D527,207 S * 8/2006 Lee ..... D6/683.1
7,172,165 B1 * 2/2007 Young ..... A45D 29/20 211/10
7,571,823 B2 * 8/2009 Richardson ..... A47F 5/00 211/10
7,581,650 B1 * 9/2009 Shen ..... A47F 7/145 211/55
7,886,916 B2 * 2/2011 Alyn ..... A47F 5/0807 211/189
8,561,816 B2 * 10/2013 Martin ..... A47F 7/147 206/425
8,967,400 B1 * 3/2015 Mumford ..... A47F 5/08 211/128.1
9,009,997 B1 * 4/2015 Kemp ..... G09F 7/18 211/55
9,215,939 B2 * 12/2015 Zobel ..... A47F 5/0823
D834,859 S * 12/2018 Hawkins ..... D6/675.4
2003/0080014 A1 * 5/2003 Ridgeway ..... A47G 23/06 206/459.5
2006/0196837 A1 * 9/2006 Dao ..... A47G 23/0216 211/11
2008/0017596 A1 * 1/2008 Brock ..... A45D 33/26 211/10
2010/0213799 A1 * 8/2010 Tigner ..... A47F 3/085 312/34.1
2013/0193157 A1 * 8/2013 Jongen ..... A47F 1/08 221/23
2018/0360232 A1 * 12/2018 Arnold ..... A47F 1/00

* cited by examiner

UNIVERSAL ACCESSIBLE HOLDER AND DISPENSING UNITS

This utility patent application is based on and claims the priority filing date U.S. Provisional Patent application (Application No. 62/520,824) filed on Jun. 16, 2017.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

The invention relates to countertop holders for tableware, such as utensils, reusable plates, cups, and glasses, for condiments, such as single serve packages of salt, pepper, sugar, sweeteners, ketchup, mustard, mayonnaise, soy sauce, coffee creamers, instant coffee, and tea bags, and for disposable goods, such as disposable plates, cups, napkins and straws.

2. Description of the Related Art

Many companies have lunch rooms or kitchenettes available to employees where hot and cold beverages and lunches can be prepared. These lunch rooms and kitchenettes often have coffee machines, hot water dispensers, refrigerators, and microwave ovens setup on countertops approximately 35½ to 37 inches height and 25 inches wide. Often, employers provide tableware, condiments, and different disposable plates and cups goods setup in the lunch room or kitchenette for use by the employees.

In 1990, the Americans with Disability Act (ADA) was promulgated that prohibits discrimination against individuals with disabilities in all public and private areas in a building open to the public. Under the act, employers with over 15 employees must provide access to employment opportunities and benefits available to people with and without disabilities. This means that the lunch rooms and kitchenettes created in the worksite for employees must comply with the ADA.

The lunch rooms and kitchenettes often have upper and lower kitchen cabinets installed above and below the countertop. Depending on whether the area under the countertop is opened or closed, the ADA sets forth different maximum forward, side and upper reach distances that must be met. For example, the current ADA, states that the maximum side reach height shall be 44 inches. If the lateral side reach is over an obstruction (e.g. a countertop over a lower closed kitchen cabinet), the maximum side reach is 24 inches.

For employers who offer tableware, condiments, and different disposable goods in a lunch room or kitchenette and present them on a countertop, these items must be stored in accessible holder and display units that satisfy the height and lateral reach restrictions set forth in the ADA.

SUMMARY OF THE INVENTION

These and other objectives are met by a universal accessible holder and dispensing unit configured to be setup on a countertop or table that is approximately 36 inches in height and 25 inches in width. The unit is configured to hold different types of tableware, condiments, and disposable paper papers and present them to users within ADA height and lateral reach distance requirements. The units have a common outer shape that can be internally modified to hold and dispense different types of tableware, condiments and disposable paper products, have uniform heights, widths and depths. Each unit has a forward extending lower tier and a rearward extending upper tier. Each tier includes a front wall and one or more optional dividing walls that divides the tier into separate smaller bins. In one embodiment, a transversely aligned secondary floor is formed between the two side walls and under the upper tier. The front walls of the upper and lower tiers may include optional tactile letters, number or symbols used by visually impaired individuals. The front walls on some of the lower and upper tiers may include optional front slots that allow items placed inside the bin behind the front wall to be easily removed from the bin.

The overall width and height of the units are sufficient to that the bins on the lower and upper bins are easily accessible to an individual standing or sitting in a wheel chair adjacent to the countertop. In the embodiments shown, each unit has an overall height of approximately 9 to 14 inches tall. When placed on a standard 36 inch tall countertop, access to the upper tier is below the 44" maximum height required by the ADA. In the embodiments presented herein, each unit is approximately 13 inches in length and approximately 13 inches deep and designed to be longitudinally aligned in an end-to-end manner on a countertop, if desired. The units may have a rear extension that extends rearward from the rear panel to re-position the unit on the countertop outward from an adjacent wall or backsplash so that the back edge of the upper tier is no more than 24 inches from the front edge of the countertop. In one embodiment, the rear extension includes two triangular side walls and top wall. The apex of the two side walls point downward thereby creating a narrow channel behind the unit. When placed on a countertop, the unit is forced rearward against the adjacent wall or backsplash which allows power cords used by other appliances to extend across the countertop and behind the unit.

In one embodiment, each side wall includes an optional front extension that is axially aligned and extends forward from the front wall. The front extensions provide stability and prevent the unit from tipped forward during normal use. The forward extension on the side walls also act as a tactile dividing walls providing a clear delimiter between units for visually impaired users.

Formed on the lower and upper tiers are optional tactile indicators or tabs that help visually impaired users to help them identify the location of the bins on the lower and upper tiers.

DESCRIPTION OF THE PREFERRED EMBODIMENT(S)

Disclosed herein is a holder and dispensing unit 8 configured to be setup in a horizontal serving surface to provide easy access by non-handicapped and handicapped individuals to various items commonly used in a lunch room or kitchenette, tea, cups, napkins, knives, forks and spoons, small food items and packaged condiments, and utensils.

Figure 1:
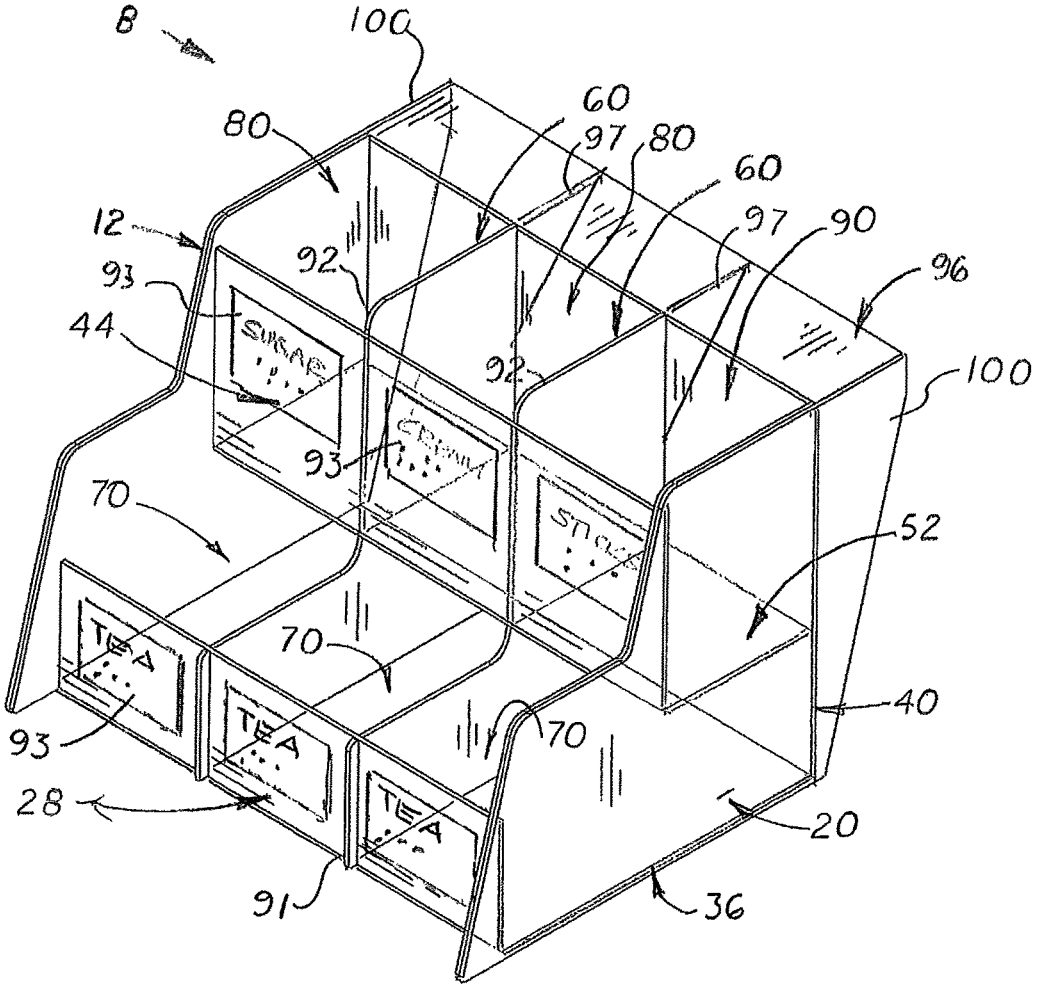
FIG. 1 is a perspective view of a loose tea dispensing and holding unit.
Figure 2:
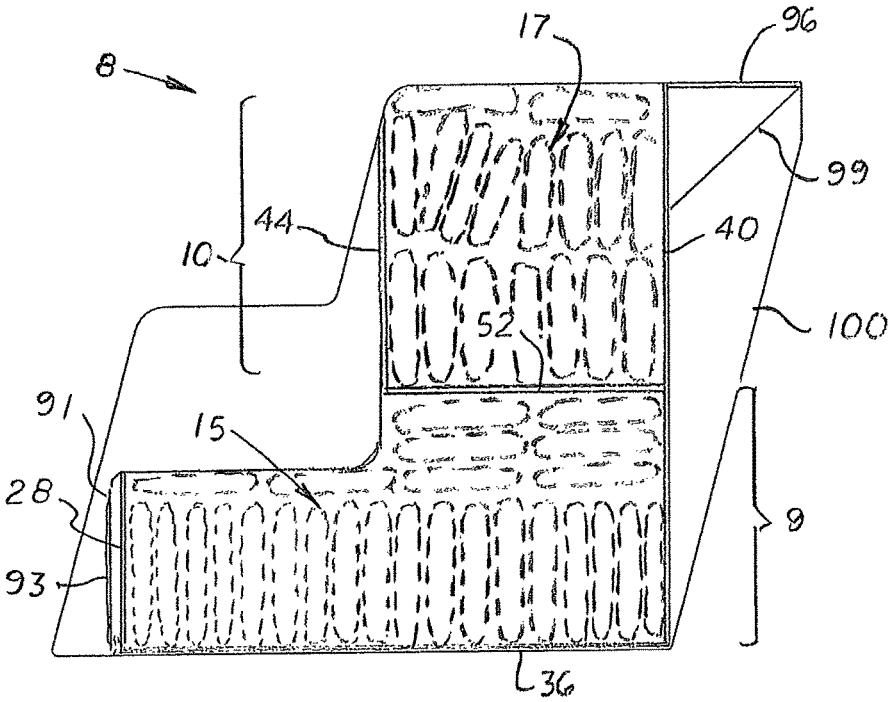
FIG. 2 is a right side elevational view of the dispensing and holding unit shown in FIG. 1.
Figure 3:
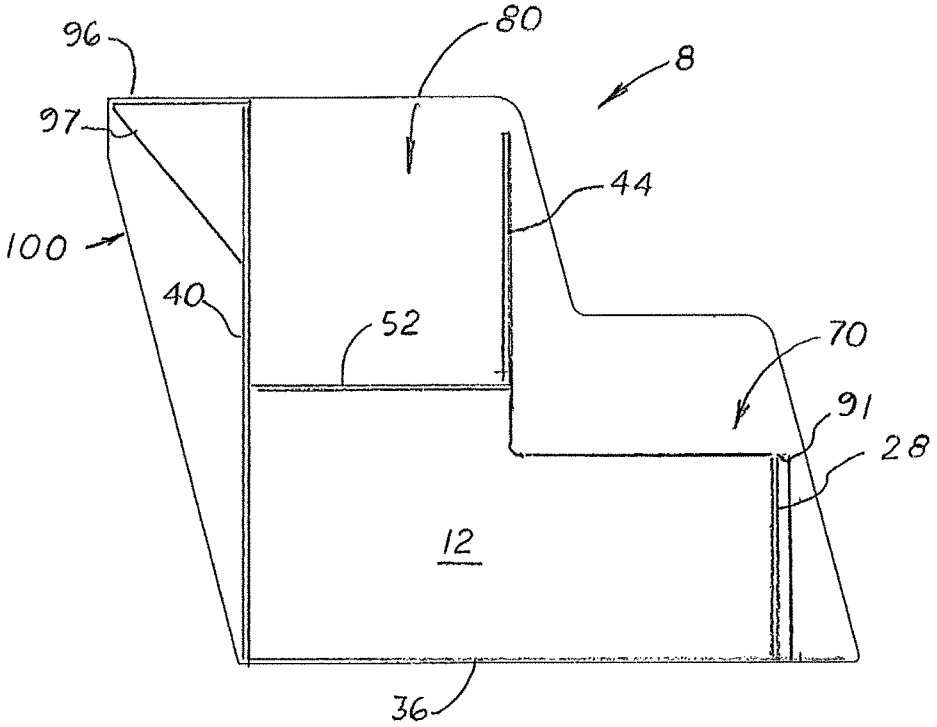
FIG. 3 is a left side elevational view of the dispensing and holding unit shown in FIGS. 1 and 2.
Figure 4:
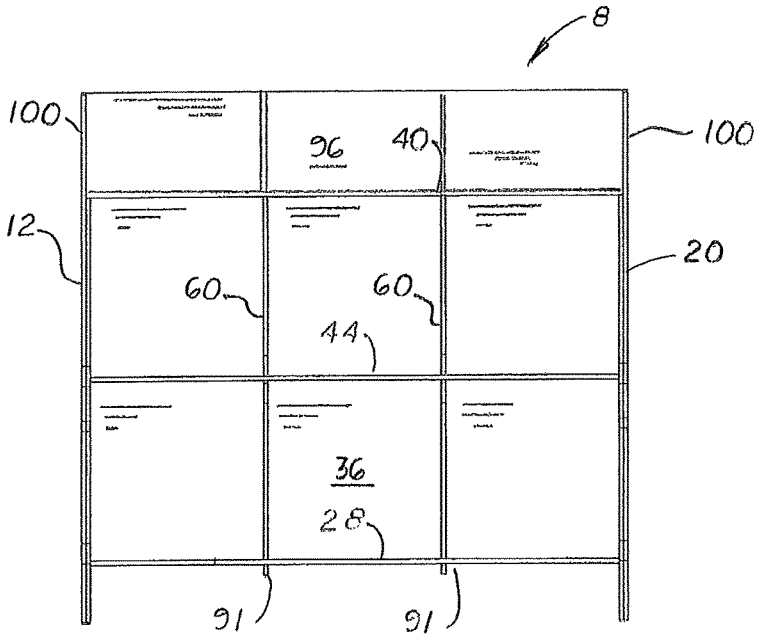
FIG. 4 is a top plan view of the dispensing and holding unit shown in FIGS. 1-3.
Figure 5:
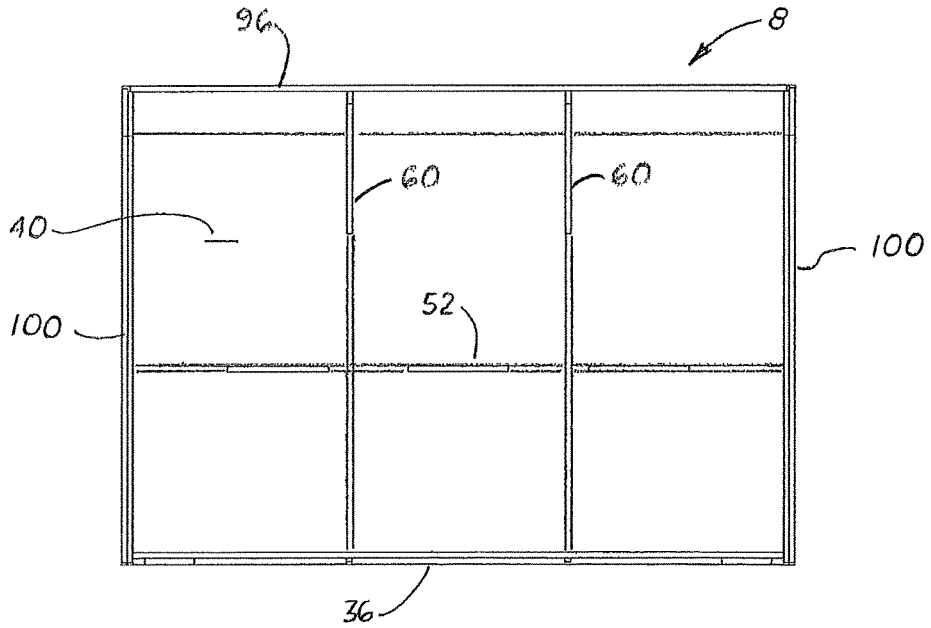
FIG. 5 is a rear elevational view of the dispensing and holding unit shown in FIGS. 1-4.
Figure 6:
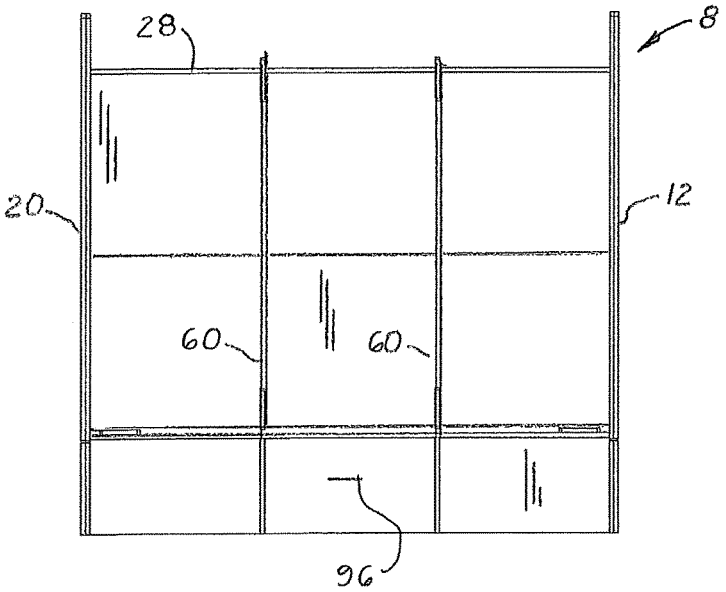
FIG. 6 is a bottom plan view of the dispensing and holding unit shown in FIGS. 1-5.
Figure 7:
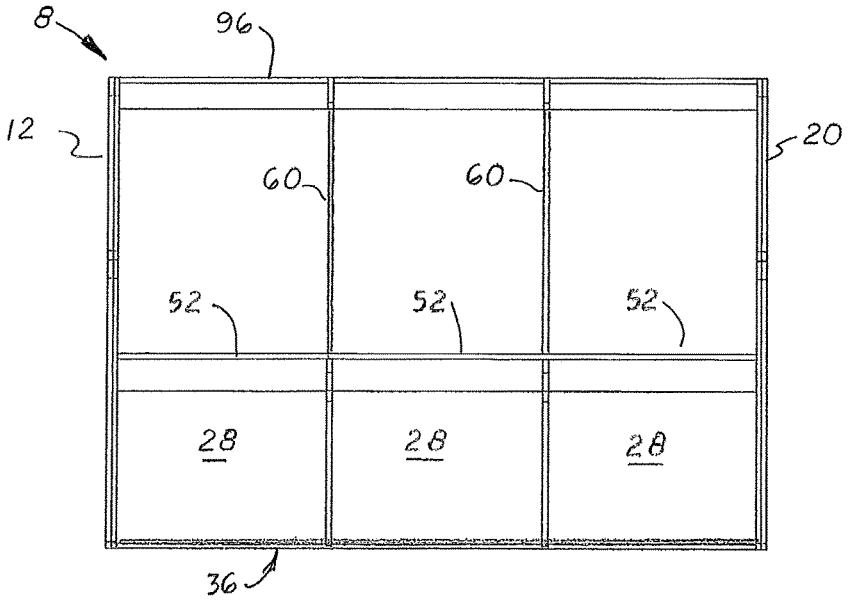
FIG. 7 is a front elevational view of the dispensing and holding unit shown in FIG. 1-6.

As shown in FIGS. 1-6, each holding unit 8 includes two L-shaped outer side walls 12, 20, a lower tier front wall 28, a planar bottom panel 36, and a rear wall 40, and an upper tier front wall 44. Disposed between the two side walls 12, 20 is an intermediate floor panel 52 that divides the unit 10 into lower and the upper tiers 9, 10, respectively, as shown in FIG. 2 Also, disposed inside the unit 8 is at least one L-shaped, inner dividing wall 60 (two dividing walls 60 shown) that are parallel to the two outer side walls 12, 20. The upper tier front walls 44 and the inner dividing walls 60 divide the lower and upper tiers 9, 10, respectively, into three separate bins, designated by reference numbers 15, 16 and 17, respectively. Each bin 15, 17 has a top opening 70, 80, and 90, respectively, enabling easy access to the items stored therein.

Formed on the lower and upper tiers 9, 10 are optional, forward extending tactile indicators 91 that helps a visually impaired user identify the location of each bin relative to an adjacent bin. In the embodiment shown in FIGS. 1-6, the tactile indicators 91 on the lower tier 9 are vertically aligned elongated tabs. The tabs are shown aligned with the inner dividing walls 60. It should be understood that the tabs could be aligned in an offset manner from the dividing wall 60. In the embodiment shown, the tabs are shown adhesively attached and extend forward approximately ¼ to ½ inch from the front surface of the front wall 28.

The unit 8 shown in FIGS. 1-7 is configured for holding a wide variety of different items, as a instant beverage pods, loose unused tea bags, or bags containing food snacks. It should be understood the units 8 may hold other items, such as sugar, creamers and sweetener, straws, salt and pepper, napkins and other packaged food items.

Figure 8:
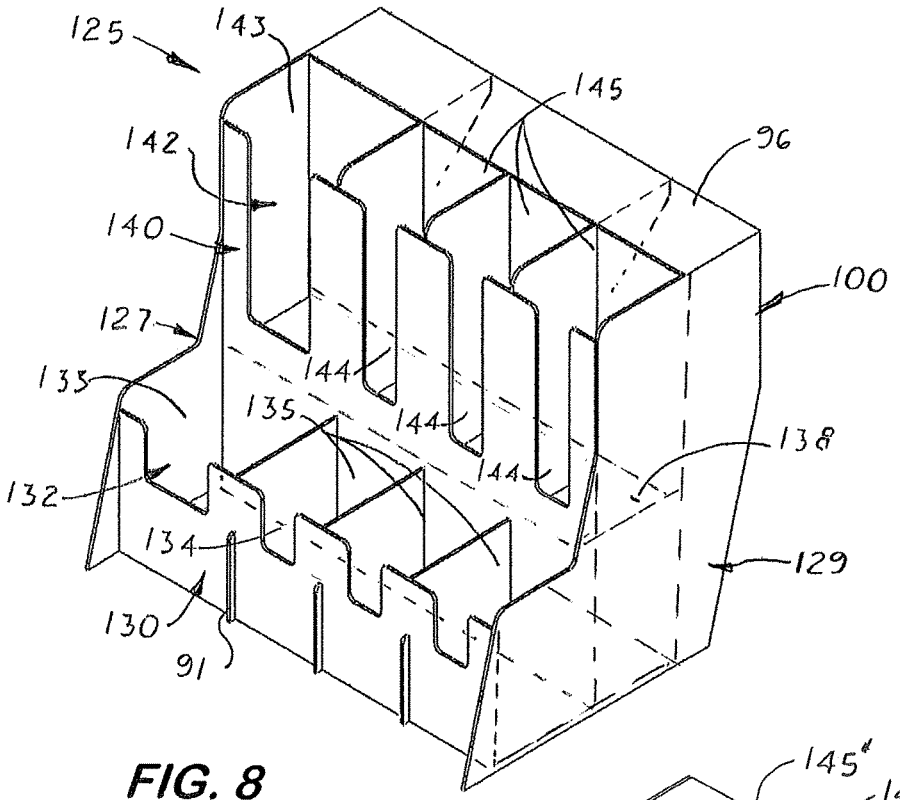
FIG. 8 is a perspective view of a cup and lid dispensing and holding unit.

FIG. 8 is a perspective view of an alternative unit, indicated by reference number 125 used to hold a plurality of vertically stacked disposable cups and lids. The unit 125 includes two modified side walls 127, 129, a modified lower tier front wall 130, three lower inside walls 135, an intermediated vertical wall 140 and three upper inside walls 145. Formed on the lower tier front wall 130 is a wide slot 132 aligned in front of the single wide bin 133 and three narrow slots 134 aligned in front of the three narrow bins 135.

The cup and lid dispensing and holding unit 125 is taller than the unit 8 shown in FIGS. 1-7. Unit 125 is configured to facilitate higher stacking of cups and lids, but still maintain the same footprint and side profile to keep a uniform appearance when placed side-by-side with the other units 125 or 8 on a countertop or table. The vertically stacked lids are presented in a more hygienic way than loose items in a drawer. This addresses people grabbing several at once to guarantee an untouched item, then discarding the rest.

Figure 9:
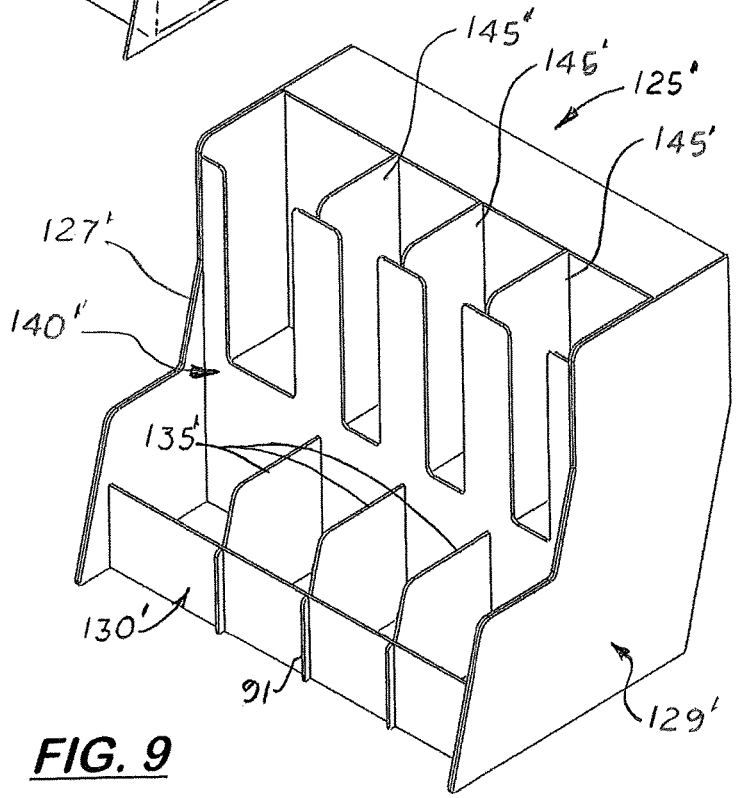
FIG. 9 is a perspective view of another embodiment of a cup and lid dispensing and holding unit.

FIG. 9 is a perspective view of another embodiment of a unit 125' similar to the unit 125 shown in FIG. 8. The unit 125', which is also used for used for dispensing disposable cups and disposable lids, includes two modified side walls 127', 129', a modified straight front lower tier wall 130', three lower inside dividing walls 135', an intermediate upper tier wall 140'. Formed inside the upper tier are three dividing walls 145'. The slots 134 used on the front wall 130 on unit 125 have been eliminated and the inside dividing walls 135' are longer than inside dividing walls 135 used on unit 125.

Figure 10:
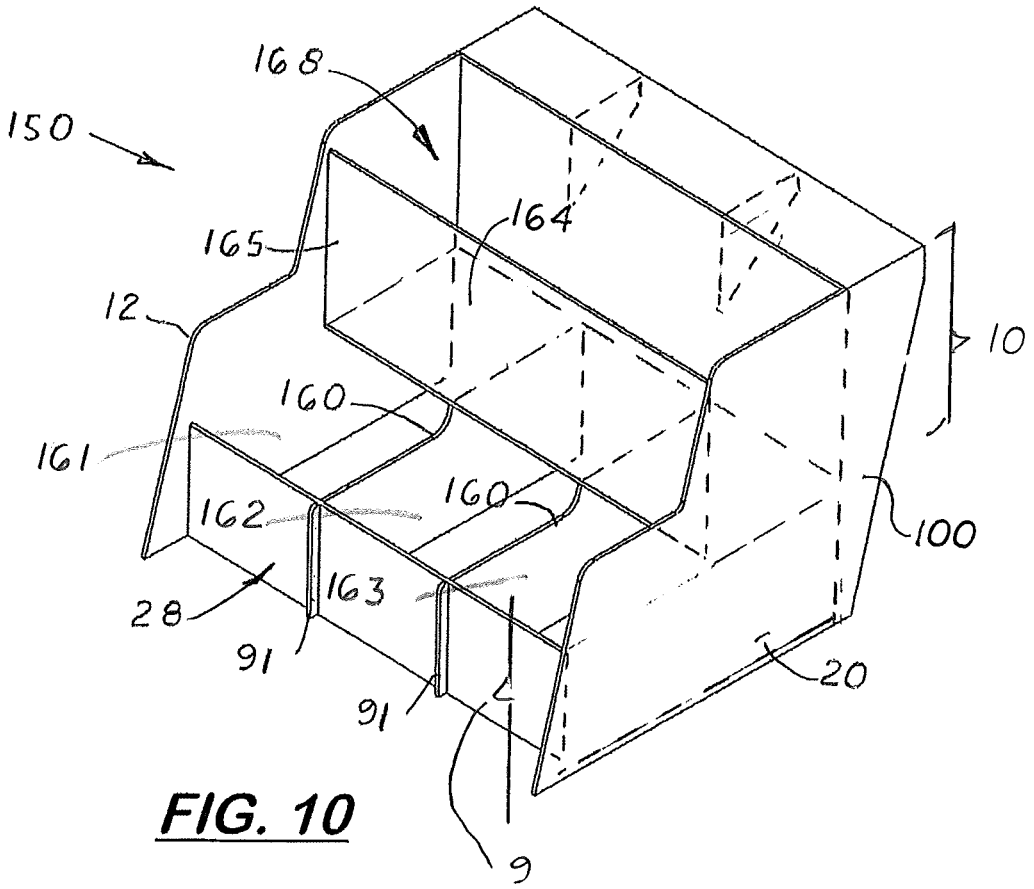
FIG. 10 is a perspective view of another embodiment of a tea bag dispensing and holding unit.

FIG. 10 is a perspective view of another unit 150 with one large rectangular shaped bin 168 formed on the upper tier 10. A secondary floor is provided under the upper tier. The bin 168 may be used to store folded napkins or straws. The lower tier 9 is divided into three small equal size bins 161, 162, 163 by dividing walls 160 and used to store utensils, and condiments. The front wall 28 is flat and extends between the two side walls 12, 20. Tactile tabs 91 may be attached to the front surface of the front wall 28. Formed on the back of the unit 150 is a rear extension 100.

Figure 11:
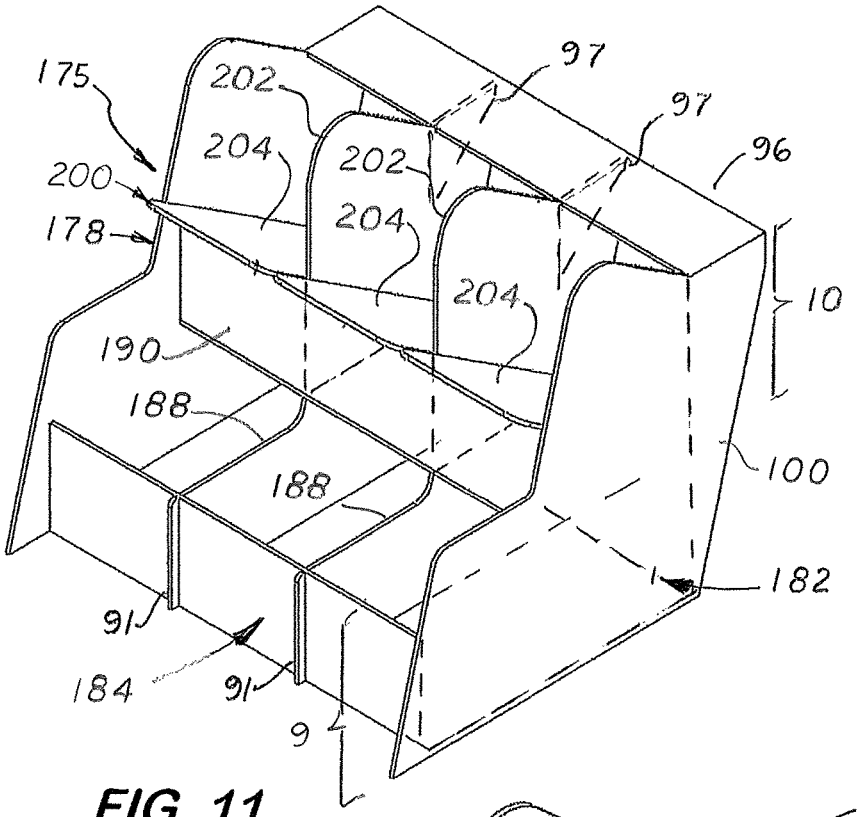
FIG. 11 is a perspective view of a utensil dispensing and holding unit.

FIG. 11 shows is a perspective view of another utensil dispensing and holding unit 175 that uses a utensil dispensing rack 200 placed into the upper large bin. The unit 175 discloses the use of modified side walls 178 and 182 and an upper front plate 184 and L-shaped two dividing walls 188 located inside the lower tier. The upper legs of the dividing walls 188 act as dividing walls 202 for the upper rack 200. Disposed transversely between the dividing walls 202 in the upper tier are three diagonal floor plates 204. The upper edges of the side walls 178, 182 and the dividing walls 188 are rounded and extend above the top edge of the unit. It should be understood, that the upper edges could be straight as shown in unit 8. The diagonal floor plates 204 rest against the top edge of the upper front plate 190. During use, utensils are placed in the bins formed in the rack 200 so that the handles extend diagonally upward and forward. The bins formed on the upper tier also work well for straws of various lengths or chopsticks since the angled forward portion allows items of any length to fit.

Figure 12:
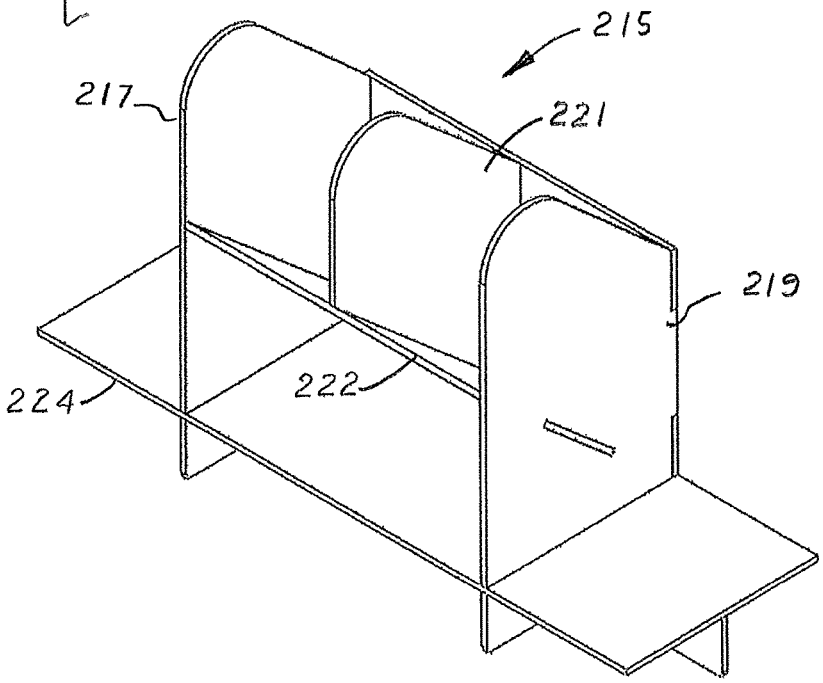
FIG. 12 is a perspective view of a utensil insert member.

FIG. 12 is a perspective view of another utensil dispensing rack 215 used in the utensil dispensing and holding unit 150 shown in FIG. 9. The dispensing rack 215 may hold stir sticks, powdered creamer and sugar.

Figure 13:
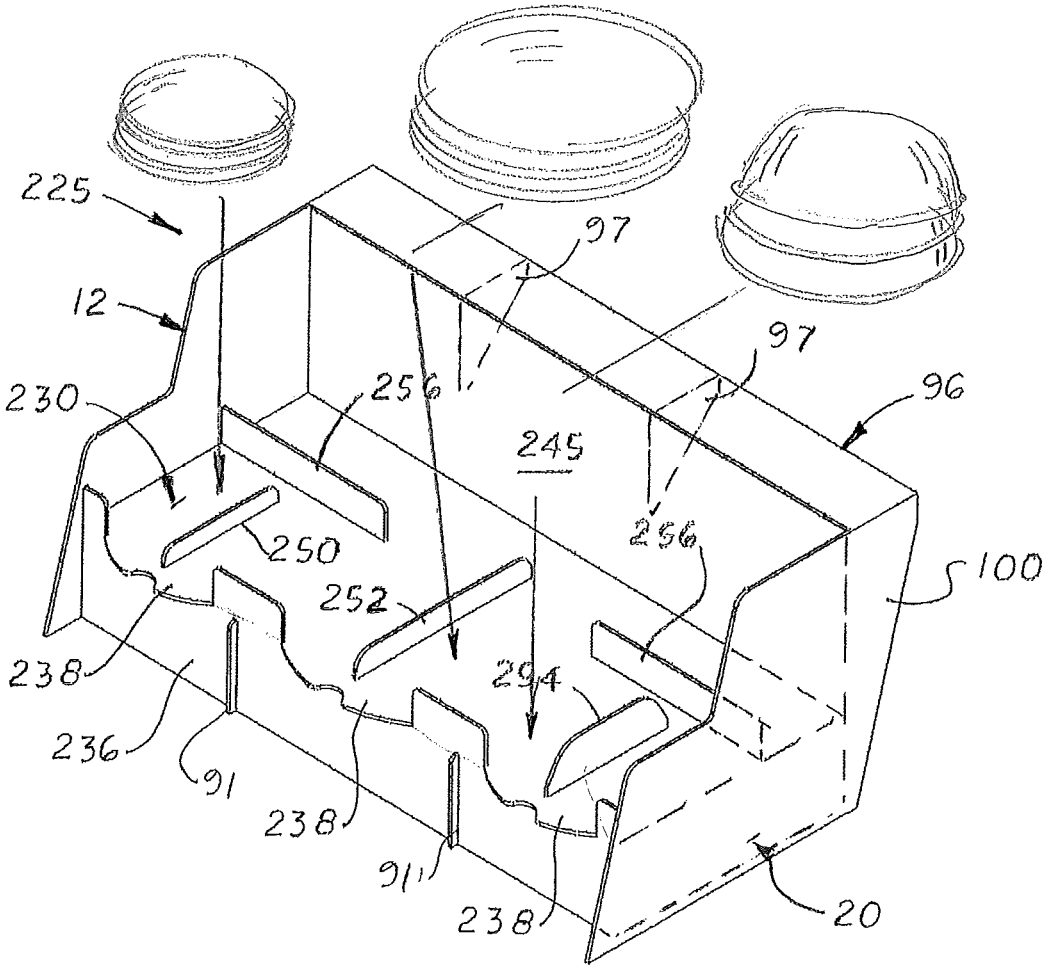
FIG. 13 is a perspective view of the dispensing and holding unit configured to hold plates and bowls.

FIG. 13 is a perspective view of the dispensing holding unit 225 configured to hold different size plates and bowls inverted and vertically stacked. The unit 225 includes two side walls 12, 20, a base 230, a vertical front wall 238, and a rear wall 245. The front wall 238 includes two plate cutouts 238. Extending upward from the base 230 are five tabs 250, 253, 254, and 256 configured to hold plates and bowls. During use, the larger paper plate is centered with the two smaller products being moved forward. The plates and bowls are positioned so they are reachable from a uniform distance along the front edge of the unit. The products all hang over the front edge right above the braille labels for easy locating. Plates and bowls are stacked face down and horizontally to minimize human contact with any eating surface.

On each unit 8, 125, 125', 170, 215 and 225, adhesive labels 93 with braille symbols may be attached to the front walls on the tiers adjacent to the bins. In other embodiments the braille symbols may be molded directly into the front walls.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A workplace utensil or condiment holder and dispensing unit, comprising:

a. two vertically aligned, L-shaped side walls spaced apart and parallel to each other, each said side wall includes a lower front section and an upper rear section that extends above said lower front section each said L-shaped side wall also includes a rear edge;

b. a vertical rear wall extending transversely between said rear edges of said L-shaped side walls;

c. a lower tier front wall that is substantially parallel to said rear wall, said lower tier front wall extends transversely between said lower front sections of said L-shaped side walls;

d. a bottom panel extending transversely between said L-shaped side walls, said rear wall and said lower tier wall and forms a partially enclosed space inside said holder and dispensing unit;

e. an upper tier front wall that is substantially parallel to said rear wall, said upper tier front wall extending transversely between said upper rear sections of said L-shaped side walls;

f. an intermediate floor panel extending transversely between opposite said L-shaped side walls and between said upper tier front wall and said rear wall, said intermediate floor panel configured to divide said partially enclosed space into an upper tier formed between said upper tier front wall and said rear wall and forms a lower tier formed between said lower tier front wall and said rear wall;

g. at least one lower dividing wall located inside said lower tier and extending from said lower front wall to said rear wall;

h. a braille symbol, an alphabet letter, or a number located on said lower tier front wall or said upper tier front wall that indicates the contents of items placed in said lower tier or said upper tier; and i. a rear extension extending rearward from said rear wall, said rear extension configured to hold said rear wall away from a vertical wall located behind said holder and dispensing unit and also form a channel behind said rear wall to enable a cable or wire to pass behind said rear wall when said holder and unit is placed on a countertop or table and said rear extension is placed against a wall surface adjacent to said countertop or table.

2. The holder and dispensing unit as recited in claim 1, further including at least one dividing wall located in said upper tier and creating at least two storage bins in said upper tier.

3. The on holder and dispensing unit, as recited in claim 1, further including at least one front extension that extends forward from said lower front tier wall.

4. The holder and dispensing unit, as recited in claim 1, further including at least one tab extension extending outward from said lower tier front wall, said tab extension being aligned with said dividing wall.

5. The holder and dispensing unit, as recited in claim 1, wherein said rear extension includes two triangular-shaped side walls and a top panel extending between said triangular-shaped side walls.

6. The holder and dispensing unit, as recited in claim 5, wherein said rear extension extends rearward and is adapted to press against a vertical wall and hold said top panel at least one inch away from said vertical wall.

7. The holder and dispensing unit, as recited in claim 1 wherein each said L-shaped side wall measures 7 to 12 inches in length and 9 to 14 inches in height.

* * * * *